US009599106B2

(12) United States Patent
Paulsen

(10) Patent No.: US 9,599,106 B2
(45) Date of Patent: Mar. 21, 2017

(54) APPARATUS EMPLOYING PRESSURE TRANSIENTS FOR TRANSPORTING FLUIDS

(75) Inventor: Jim-Viktor Paulsen, Drammen (NO)

(73) Assignee: IMPACT TECHNOLOGY SYSTEMS AS, Oslo (NO)

( * ) Notice: Subject to any disclaimer, the term of this patent is extended or adjusted under 35 U.S.C. 154(b) by 974 days.

(21) Appl. No.: 13/322,358

(22) PCT Filed: May 26, 2010

(86) PCT No.: PCT/NO2010/000190
§ 371 (c)(1),
(2), (4) Date: Jan. 27, 2012

(87) PCT Pub. No.: WO2010/137991
PCT Pub. Date: Dec. 2, 2010

(65) Prior Publication Data

US 2012/0118391 A1 May 17, 2012

(30) Foreign Application Priority Data

May 27, 2009 (NO) ..... 20092071

(51) Int. Cl.
*F15C 3/00* (2006.01)
*F04B 43/073* (2006.01)

(52) U.S. Cl.
CPC ..... *F04B 43/0736* (2013.01); *Y10T 137/0318* (2015.04); *Y10T 137/8593* (2015.04)

(58) Field of Classification Search
CPC ..... F04B 43/0736; Y10T 137/0318; Y10T 137/8593
(Continued)

(56) References Cited

U.S. PATENT DOCUMENTS 3,189,121 A 6/1965 Vander Stoep
3,367,443 A 2/1968 Mayne
(Continued)

FOREIGN PATENT DOCUMENTS

CN 1768202 A 5/2006
CN 1921987 A 2/2007
(Continued)

OTHER PUBLICATIONS

Singh: "Generation of pressure pulses by impacting an opposed-anvil setup with a low-velocity projectile", Rev. Scl. Instrum,vol. 60 (2), Feb. 1989, pp. 253-257.
(Continued)

*Primary Examiner* — Jessica Cahill
(74) *Attorney, Agent, or Firm* — Muncy, Geissler, Olds & Lowe, P.C.

(57) ABSTRACT

An apparatus employing pressure transients for transporting fluids from one reservoir to another, includes an at least partly enclosed space, and a body herein, where the body is movable relatively to the interior of the space. The apparatus further includes an opening in the enclosed space to allow a fluid to flow alternately in the direction into and out, and conduits in fluid communication with the opening and connected to the reservoirs. Further, an object is arranged to collide with the body so as to generate pressure transients in the partly enclosed space in order to produce a flow of fluid in the direction from the partly enclosed space towards the second reservoir, and to produce a flow of fluid in the direction from the first reservoir towards the partly enclosed space.

17 Claims, 12 Drawing Sheets

(58) Field of Classification Search
USPC ..... 137/829, 833, 13, 14, 391, 409; 239/589–589.1; 166/105; 60/497; 290/53
See application file for complete search history.

(56) References Cited

U.S. PATENT DOCUMENTS

| | | | | |
|---|---|---|---|---|
| 3,586,461 | A | 6/1971 | Erlandson | |
| 3,974,652 | A | 8/1976 | Lovmark | |
| 4,147,228 | A | 4/1979 | Bouyoucos | |
| 4,341,505 | A | 7/1982 | Bentley | |
| 4,429,540 | A * | 2/1984 | Burnham | 62/188 |
| 4,621,656 | A * | 11/1986 | Ichimaru | 137/625.66 |
| 4,622,473 | A * | 11/1986 | Curry | 290/53 |
| 4,863,220 | A | 9/1989 | Kolle | |
| 4,901,290 | A | 2/1990 | Feld et al. | |
| 4,917,575 | A * | 4/1990 | Miller et al. | 417/52 |
| 5,000,516 | A | 3/1991 | Kolle et al. | |
| 5,249,929 | A * | 10/1993 | Miller et al. | 417/207 |
| 5,282,508 | A | 2/1994 | Ellingsen et al. | |
| 5,628,365 | A | 5/1997 | Belonenko | |
| 5,950,726 | A | 9/1999 | Roberts | |
| 5,950,736 | A | 9/1999 | Goldstein | |
| 6,015,010 | A | 1/2000 | Kostrov | |
| 6,020,653 | A * | 2/2000 | Woodbridge et al. | 290/53 |
| 6,237,701 | B1 | 5/2001 | Kollé et al. | |
| 6,241,019 | B1 | 6/2001 | Davidson et al. | |
| 6,729,042 | B2 | 5/2004 | Lee | |
| 6,910,542 | B1 | 6/2005 | Walter | |
| 6,976,507 | B1 | 12/2005 | Webb et al. | |
| 7,245,041 | B1 * | 7/2007 | Olson | 290/53 |
| 7,304,399 | B2 * | 12/2007 | Leijon et al. | 290/42 |
| 7,318,471 | B2 | 1/2008 | Rodney et al. | |
| 7,405,489 | B2 * | 7/2008 | Leijon et al. | 290/42 |
| 7,464,772 | B2 | 12/2008 | Hall et al. | |
| 7,816,797 | B2 * | 10/2010 | Nair | 290/42 |
| 2001/0017206 | A1 | 8/2001 | Davidson et al. | |
| 2002/0050359 | A1 | 5/2002 | Eddison | |
| 2003/0201101 | A1 | 10/2003 | Kostrov et al. | |
| 2004/0256097 | A1 | 12/2004 | Byrd et al. | |
| 2005/0189108 | A1 | 9/2005 | Davidson | |
| 2005/0224229 | A1 | 10/2005 | Blacklaw | |
| 2005/0236190 | A1 | 10/2005 | Walter | |
| 2006/0293857 | A1 | 12/2006 | Moos et al. | |
| 2007/0187090 | A1 | 8/2007 | Nguyen et al. | |
| 2007/0187112 | A1 | 8/2007 | Eddison et al. | |
| 2007/0251686 | A1 | 11/2007 | Sivrikoz et al. | |
| 2009/0107723 | A1 | 4/2009 | Kusko et al. | |
| 2009/0159282 | A1 | 6/2009 | Webb et al. | |
| 2009/0178801 | A1 | 7/2009 | Nguyen et al. | |
| 2009/0200018 | A1 | 8/2009 | Sivrikoz et al. | |
| 2009/0272555 | A1 | 11/2009 | Wisakanto et al. | |
| 2009/0301721 | A1 | 12/2009 | Barykin | |
| 2009/0308599 | A1 | 12/2009 | Dusterhoft et al. | |
| 2011/0011576 | A1 | 1/2011 | Cavender et al. | |
| 2011/0108271 | A1 | 5/2011 | Hinkel et al. | |
| 2012/0175107 | A1 | 7/2012 | Kostrov et al. | |

FOREIGN PATENT DOCUMENTS

| | | | |
|---|---|---|---|
| CN | 101432502 | A | 5/2009 |
| DE | 75164 | | 8/1893 |
| DE | 102005005763 | | 8/2006 |
| EP | 2 063 123 | A2 | 5/2009 |
| EP | 2063126 | A2 | 5/2009 |
| JP | 2001082398 | | 3/2001 |
| NO | 20092071 | | 11/2010 |
| RU | 16527 | U1 | 1/2001 |
| RU | 2171354 | | 7/2001 |
| SU | 1710709 | A1 | 2/1992 |
| WO | WO 2004/085842 | A1 | 10/2004 |
| WO | WO2004/113672 | A1 | 12/2004 |
| WO | WO2005/079224 | A2 | 9/2005 |
| WO | WO2005/093264 | A1 | 10/2005 |
| WO | WO2006/129050 | A1 | 12/2006 |
| WO | WO2007/076866 | | 7/2007 |
| WO | WO2007/076866 | A1 | 7/2007 |
| WO | WO2007/100352 | A1 | 9/2007 |
| WO | WO2007/113477 | A1 | 10/2007 |
| WO | WO 2007/127766 | A1 | 11/2007 |
| WO | WO2007/139450 | A2 | 12/2007 |
| WO | WO2008/054256 | A1 | 5/2008 |
| WO | WO2009/063162 | A2 | 5/2009 |
| WO | WO2009/082453 | A2 | 7/2009 |
| WO | WO2009/089622 | A1 | 7/2009 |
| WO | WO/2009/111383 | A2 | 9/2009 |
| WO | WO2009/132433 | A1 | 11/2009 |
| WO | WO2009/150402 | A2 | 12/2009 |
| WO | WO2010/137991 | A | 12/2010 |
| WO | WO2011/157740 | A1 | 12/2011 |

OTHER PUBLICATIONS

F. Herrmann and M. Seitz: "How does the ball-chain work?", Am. J. Phys. vol. 50 (11), Nov. 1982, pp. 977-981.
Pride, et al.: "Seismic stimulation for enhanced oil recovery", Geophysics, vol. 73, Sep. 17, 2008, pp. 023-035.
F. Herrmann and P. Schmalzle: "Simple explanation of a well-known collision experiment", Am. J. Phys., vol. 48 (8); Aug. 1981, pp. 761-764.
Maurice Dusseault, et al., "Pressure Pulsing: The Ups and Downs of Starting a New Technology", JCPT, Apr. 2000, vol. 39, No. 4, pp. 13-19.

* cited by examiner

APPARATUS EMPLOYING PRESSURE TRANSIENTS FOR TRANSPORTING FLUIDS

FIELD OF THE INVENTION

This invention relates to transport of fluids by an apparatus described in the introductory part of claim 1. More specifically the invention relates to an apparatus which employs pressure transients to transport fluids. Moreover, the invention describes exemplary applications where the energy needed to generate said pressure transients are captured from ocean waves. Hence, in these applications the described apparatus operates as an apparatus for capturing the energy in ocean waves.

BACKGROUND

There is one type of device for transporting fluids that has almost been forgotten, or overlooked for practical reasons which employs a physical phenomenon commonly known as "Water Hammer". The first device of this type was built in 1772 by J. Whitehurst for use in a brewery and is classified as "Hydraulic ram pumps" or just "Ram pumps".

"Water Hammer" is a phenomenon that occurs when a fluid flowing in a pipeline experience a sudden halt by e.g. closing a valve, thereby causing the fluid motion to generate a pressure transients. However, the "Ram pumps" also employ the reversed process, i.e. where pressure transients produces a fluid flow. The reversed process is not part of the "Water Hammer" phenomena, and it has mostly been ignored resulting in a close to non-existing theoretical knowledge about this process. FIG. 1 illustrates a prior art "Ram pump" where a flow of fluid is sent through a "Drive pipe" and a "Waste valve" is employed to generate a positive pressure transient within a "Valve box". The positive pressure transient is subsequently producing a flow of fluid that transfers at least a fraction of the supplied fluid to the "Storage tank". The transferred fluid is the same fluid that prior to the transfer was flowing in the "Drive pipe", and a "Ram pump" is thus a pumping device which utilizes a small fall of fluid to lift a fraction of the supplied fluid to a height that is greater than the initial height of the fluid.

The "Water Hammer" phenomenon also occurs if a body, which is in contact with a fluid at rest, experiences a sufficiently sudden movement, since this is, due to symmetry of relative motion, essentially the same as a sudden halt of a flowing fluid by closing of a valve. An equation relating the pressure transients to the fluid flow speed was formulated by the Russian scientists Nikolai Joukowsky. This equation states that $\Gamma=\rho cu$, where $\Gamma$ is the pressure transient, $\rho$ is the density of the fluid, c is the sound speed in the fluid and u is the fluid flow velocity. N. Joukowsky published this equation in 1898 after extensive experiments of the "Water Hammer" phenomena in long steel pipes, and is hence commonly known as the Joukowsky equation. However, the same equation was introduced by the German scientist Johannes von Kries in 1883 based on his studies of blood flow in the arteries.

In industrial pumping application mostly three kinds of pressures are observed: static pressure, pressure waves and pressure transients.

Static pressure is employed in all fluid transporting devices today with only one exception, namely applications where "Ram pumps" are used. Fluids are transported by the gradient of static pressure along the pipelines which the pumping device has established in the system. The static pressure is constant in time during the normal steady state operation of the pumping device, but the pressure is time dependent during the start up of the pump until a steady state is reached. Hence, in the initial phase a pumping device can produce pressure waves. A purely static pressure is not possible to obtain in any industrial pumping application since there will always be some disturbances in the steady state operation. However, various means are applied in order to maintain a close to static situation.

A pressure wave is not capable of generating a net transport of fluids since pressure waves only generate oscillations in a fluid but no net transport. An example of pressure waves are sound waves in air. Notice that the disturbances mention above are mostly pressure waves, and hence one employ different procedures to minimize the generation of these useless pressure waves.

If a pumping device makes a sudden stop due to some failure of the operation of the pump, a pressure transient can be generated in the same way as in the case of a sudden closing of a valve.

In many industrial applications "Water Hammer" is regarded as a dangerous phenomenon that should be avoided due to the plausible occurrence of disruptive cavitations generated by the pressure transients. The pressure transient $\Gamma$, which is positive in the beginning, can change sign to become negative due to interactions with some solid surfaces in the system. If the sum of the local pressure and the pressure transient is less than the vapor pressure, cavities containing vapor are formed. After some time the cavity will collapse (implode), i.e. when the pressure in the neighborhood again rises above the vapor pressure. The cavity walls thus rush towards one another thereby generating hard impulse on the system owing to the low degree of compressibility of liquids. The impulses spreading out from each collapsed cavity is an important, and usually undesirable, feature, often heard as disturbingly loud noises in applications such as water supply systems and hydraulic pumps. Most seriously, the continual collapse of cavities leads rapidly to deterioration and erosion of nearby solid surfaces. To summarize one can state that during the "Water Hammer" phenomena all of the positive pressure transients become negative pressure transients, and all of the negative pressure transients are generating disruptive cavitations. Hence, to actively generate the "Water Hammer" phenomena for industrial applications have not been considered feasible among experts in the field.

Pressure transients are avoided in industrial applications, mainly since they would normally lead to disruptive cavitations in the system as in the case of the "Water Hammer" phenomena. One of many reasons to actively produce pressure transients is that pressure transients can be both positive and negative as mention above, and thus pressure transients in a partly enclosed space with one or more openings can produce a flow in the direction out of and into the partly enclosed space. This effect is apparent from the Joukowsky equation $\Gamma=\rho cu$, thus when $\Gamma$ is positive u is positive (flow in the direction out of a partly enclosed space), and when $\Gamma$ is negative u is negative (flow in the direction into a partly enclosed space). In this way both positive and negative pressure transients generate flows, thereby suppressing disruptive cavitations due to negative pressure transients. Notice that only one fraction of the positive pressure transients produces a flow, whereas the other fraction become negative pressure transients due to the abovementioned interactions at some solid surfaces in the system. Since the pressure transients cannot be simultaneously negative and positive, such inflows and outflows may in principle occur through the same opening. The possibility of applying only one opening is an important uniqueness of the described apparatus compared with all fluid transporting devices today that employs one opening for the inflow and one for the outflow. The only exception is the "Ram pump" that has one more opening for the "Waste valve", thus a "Ram pump" has three openings.

How does the "Ram pump" avoid the disruptive cavitations that normally occur during the "Water Hammer" phenomena? Looking at FIG. 1 one realizes that the "Drive pipe" and the "Supply head" ensures that any disruptive cavitations which are about to develop within the "Valve box" are terminated by a sufficient inflow of fluid from the "Drive pipe". Hence the sum of the local pressure and the pressure transients are not allowed to become less than the vapor pressure due to this inflow. In other words, any negative pressure transient in the "Valve box" is generating a negative flow (a flow into the "Valve box") according to the Joukowsky equation. It is important to notice that the hydrostatic head given by the "Supply head" needs to be large enough so that said inflow becomes sufficient to in order to avoid any disruptive cavitations.

What is a pressure transient? There are many ways of generating a static pressure or a pressure wave, but there are only a few known situations where pressure transients occur. The most known case where pressure transients appear is during the "Water Hammer" phenomenon. Pressure transients are a time dependent propagating phenomenon like pressure waves, but unlike pressure waves fluids can be transported by pressure transients in accordance with the Joukowsky equation.

To find out what pressure transients are one need to know more about the concept of pressure in fluids. On a microscopic level pressure is the results of the thermal motion of the particles in the fluid, and one can interpret pressure as energy density in the fluid. However, on a macroscopic level pressure is more commonly regarded as the ability of the fluid to exert a force on a body. The force F that the pressure p inside a hydraulic cylinder can push the piston (body) with is given by $F=Ap$, where A is the size of the surface of the piston which is in contact with the fluid in the hydraulic cylinder. Hence, a general method of producing a pressure p inside a hydraulic cylinder is to act on the piston (body) with a force F obtaining a pressure given by $p=F/A$. In this way a static pressure can be generated by a constant force, and a pressure wave is obtained by employing a time dependent oscillating force.

To our knowledge, pressure transients can only be generated by a collision process. The momentum of a fluid flowing in a pipeline (with cross section $\sigma$) disappears during a time interval $\Delta t$ after a valve is suddenly closed, and due to the conservation of momentum something must be created during this time interval $\Delta t$. To find out what is happening one can follow the work by N. Joukowsky. Newton second law can be written in the momentum form $R\Delta t=\Delta(mu)$, where F is the force, $\Delta t$ is a time interval and $\Delta(mu)$ is the change in momentum of a body with mass m and velocity u. Applying that a pressure transient can be expressed as $\Gamma=F/\sigma$ one can write that $\Gamma\sigma\Delta t=\rho uV=\rho u\sigma L=\rho u\sigma c\Delta t$, where $\sigma$ is the cross section of the pipeline, $\Delta t$ is the time interval during which the momentum $\rho u$ disappears, $V=\sigma L$ is the volume V of the part of the fluid (with density $\rho$) where the momentum has disappeared, and L is the length that the pressure transient $\Gamma$ has propagated with the sound speed c during the time interval $\Delta t$. Hence, the Joukowsky equation $\Gamma=\rho cu$ is obtained.

One could argue that the pressure transient C is generated by a force F as in the case of an ordinary static pressure p, since the relation $\Gamma=F/\sigma$ is employed. This is, however, a force that appears in a collision process and the only way to produce such a force is to perform a collision. As mentioned above, pressure transients can be produced by a body (which is in contact with a fluid at rest) which experiences a sufficiently sudden movement. It is now possible to specify more precisely what kind of movement that is needed in order to obtain pressure transients. The movement of said body must be generated by a collision process. The collision process can be obtained with an object (having a nonzero momentum) colliding with said body. More precisely, a collision process is an event where said object is set in motion at time $\tau$ and gains a nonzero momentum (during a time interval T) before it collides with said body at a later time $\tau+T$.

The pressure loss p along a pipeline with length L during laminar constant flow is given by the Hagen-Poiseuille equation $p=32\mu Lu/d^2$, where $\mu$ is the coefficient of viscosity and u is the fluid flow velocity. Introducing the cross section $\sigma=\pi d^2/4$ of the pipeline, the Hagen-Poiseuille equation can be written as $p=8\pi\mu Lu/\sigma$. Hence, an ordinary pumping device must produce a static pressure that is equal to the pressure loss p in order to maintain the fluid flow velocity u in the pipeline. In the case of turbulent flow the pressure loss can be estimated with the Darcy-Weisbach equation $p=2fL\rho u^2/d$ if an empirical friction factor f is introduced, and the dependence of the friction factor f with the Reynolds number is often illustrated in Moody diagrams. It is important to notice that the relation between the flow velocity u and pressure p in both the Hagen-Poiseuille and Darcy-Weisbach equations are different from the relation obtained with the Joukowsky equation $\Gamma=\rho cu$, hence there is a fundamental difference in how a pressure p and a pressure transient $\Gamma$ can produce a fluid flow velocity u.

FIG. 8 displays a prior art piston pump where a piston is connected to a machinery, but the mechanical movement of the piston by the machinery is not able to generate pressure transients inside the hydraulic cylinder.

A prior art piston pump is also shown in FIG. 9, but now the piston is moved by a fluid expanding in a chamber. This chamber could be a combustion chamber and the expanding fluid could be some kind of fossil fuel, and again no pressure transients could be produced in the hydraulic cylinder. FIG. 10 outlines a prior art displacement pump where a fluid expanding in the chamber pushes the membrane and thus transport fluid out of the hydraulic cylinder. Such a prior art displacement pump is also disclosed in U.S. Pat. No. 3,586,461. However, the motion of the membrane produces no pressure transients in the hydraulic cylinder.

All the prior arts pumps illustrated in the FIGS. 8-10 and disclosed in U.S. Pat. No. 3,586,461 have one thing in common. They are not able to generated pressure transients, since their operations do not involve any collision process. Hence, the described apparatus therefore employs a heavy object that collides with the piston in order to obtain pressure transients in the hydraulic cylinder.

Problems to be Solved by the Invention

Based on the state of the known art the objective with the invention is to provide a robust and efficient apparatus for transporting fluids by employing pressure transients, and where the need of a "Waste valve" and a "Drive pipe" (FIG. 1) to generate said pressure transients are removed.

One objective with the invention is to provide an apparatus for transporting fluids that is new in many fundamental aspects. The apparatus produces a pulsating fluid flow that is different from the flow obtained with ordinary pumps, but to some extent similar to that of the "Ram pump". The "Ram pump" and the described apparatus both employ pressure transients to transport fluids. However, the "Ram pump" generates these transients by opening and closing a "Waste valve", whereas the described inventive apparatus generates such pressure transients utilizing a sudden movement of at least one body (piston). Said movement must be sufficiently sudden, and in the described apparatus this is obtained by at least one object (a hammer) colliding with said body (piston).

SUMMARY OF THE INVENTION

According to the invention said objectives are achieved by an apparatus for transport of fluids as stated in the introduction, and having the characteristic features stated in the independent claim 1. Advantageous embodiments of the invention are stated in the remaining dependent claims.

More specifically, the invention relates to an apparatus employing pressure transients for transporting fluids comprising at least one partly enclosed space, at least one body in said at least one partly enclosed space, where said at least one body is movable relatively to the interior of said at least one partly enclosed space, at least one opening in said at least one enclosed space which allows a fluid to flow alternately in the direction into and out of said at least one partly enclosed space, at least one first conduit and at least one second conduit in fluid communication with at least one of said at least one opening, at least one first reservoir and at least one second reservoir connected to said at least one first conduit and at least one second conduit respectively, at least one first mechanical unit and at least one second mechanical unit in said at least one first conduit and at least one second conduit respectively, where said at least one first mechanical unit only allows flow in said at least one first conduits from said at least one first reservoir and towards said at least one partly enclosed space, and said at least one second mechanical unit only allows flow in said at least one second conduit in the direction from said at least one partly enclosed space and towards said at least one second reservoir.

The invention is further characterized in that at least one positive pressure transient is generated in at least one of said at least one partly enclosed space by at least one object, with nonzero momentum, colliding with said at least one body, where at least part of said at least one positive pressure transient produces flow of fluid out of said at least one partly enclosed space through said at least one second mechanical unit and into said at least one second reservoir, and at least one negative pressure transient is generated in said at least one partly enclosed space, where said at least one negative pressure transient, together with the resulting at least one hydrostatic head between at least one of said at least one first reservoirs and at least one of said at least one partly enclosed space, produce flow of fluid out of said at least one first reservoir through said at least one first mechanical unit and into said at least one partly enclosed space.

An advantageous embodiment of the invention is to terminate any disruptive cavitations occurring in said partly enclosed space by assuring a sufficient flow of fluid into said partly enclosed space(s). Preferably this is obtained by arranging at least one of said first reservoir(s) with a sufficiently hydrostatic head between at least one of said partly enclosed space(s) and at least one of said first reservoir(s), so that said sufficient flow of fluid comes from at least one of said first reservoir(s).

Preferably at least one of said partly enclosed space(s) and at least one of said body or bodies are a hydraulic cylinder and a piston, respectively.

Another advantageous embodiment is to arrange at least one chamber that is filled with a mixture of liquid and gas, wherein one or more third conduits are connected to the liquid filled parts of the chamber(s). Said third conduit(s) is/are in fluid communication with said partly enclosed space(s) through said second mechanical unit(s). Preferably at least one membrane suitable for separating gas and liquid is arranged within at least one of said chamber(s). Said chamber(s) may e.g. be any kind of pressure tanks and/or hydraulic accumulators.

Said first and second mechanical units are with advantage valves of specific types such as one-way valves, check valves, restrictor check valves, throttle check valves, restrictor one-way valves or/and throttle one-way valves.

Furthermore, said conduits consist preferably of pipelines, e.g. pipelines made of stainless steel and/or plastic.

As an alternative to the above-described embodiments the inventive apparatus may be employed in one or more heat exchanging systems such as heating or cooling systems. This may be achieved by merging at least one of said first reservoir(s) with at least one of said second reservoir(s), thereby obtaining at least one common reservoir into which both an inflow and an outflow of fluid are present.

Another possible application using one or more of the above-mentioned embodiments is to employ at least one of said at least one second reservoir as a hydropower reservoir. Moreover, in some other applications at least one of said reservoir(s) might be replaced by a pressure tank, and at least one of said pressure tank(s) could be connected to hydropower turbine(s).

Another possible application is to use the apparatus as described above and claim 1-8 as an energy converting system, wherein at least one of said object(s) is/are connected to at least one wave motion capturing system.

One apparatus having connected said wave motion capturing system, and thus suitable for capturing energy in wave motions, has one or more objects connected to one or more floating buoys which may be set in motion by waves. Said motions are then generating movements of said object(s), thereby causing a non-zero momentum of said object(s) prior to the collision(s) with at least one of said body or bodies.

Said object(s) is/are preferably connected to one or more buoy(s) by one or more cord(s) running through pulleys, wherein at least one pulley is/are anchored to at least one sinker, and at least one of the other pulleys is/are connected to a fixed construction.

In another, alternative apparatus with said wave motion capturing system, and thus suitable for capturing energy in wave motions, said object(s) is/are connected to at least one wall which can be set in motion by waves, and that the motion of said at least one wall induces movement of said object(s), and thereby obtaining a nonzero momentum of said object(s) prior to collision with at least one of said body or bodies Said object(s) in the latter described apparatus is/are preferably connected to said wall with at least one cord running through one or more pulleys that are linked to a fixed construction and where said wall(s) is/are anchored to at least one sinker with one or more joints.

The inventive apparatus may be produced employing known components, and the invention is not by any means limited to neither choice of material during the manufacturing of components such as said object(s), nor how said object(s) are moved towards and away from said piston(s). However, one possible method of achieving such movement of the object(s) is to apply ocean waves as mentioned above. Ocean waves are in nature a periodic or quasi-periodic phenomenon, which may contain large amount of energy. Hence the described apparatus may constitute an ocean wave energy converting system as described above when at least one of said at least one second reservoir is a hydropower reservoir. More specifically, the inventive apparatus may be applied as said ocean wave energy converting system(s) in which said object(s) constitute a part of an ocean wave motion capturing system(s). Such an apparatus allows the construction of an ocean wave power concept where said ocean wave motion capturing system(s) and said ocean wave energy converting system(s) are fully disconnected. This ocean wave power concept would most probably lead to a more robust solution compared to prior art solutions. For ocean wave motion capturing systems either prior art systems or new innovative solutions may be employed to assure a movement of the object(s) due to the ocean waves.

DETAILED DESCRIPTION OF EMBODIMENTS

Figure 1:
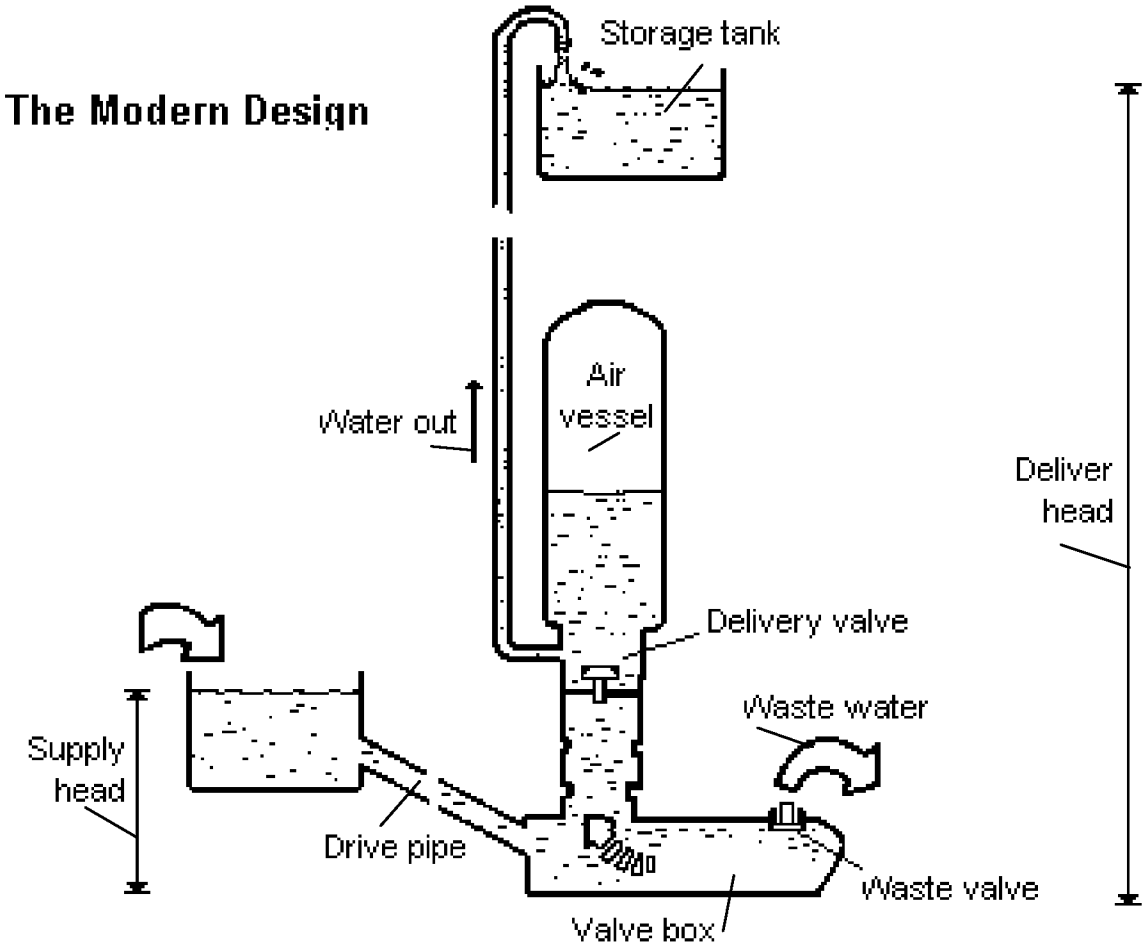
Fig. 1 (Prior Art)
FIG. 1 illustrates a Prior Art "Ram pump" where a flow of fluid is sent through a "Drive pipe", and a "Waste valve" is employed to generate a pressure transient within a "Valve box".
Figure 2:
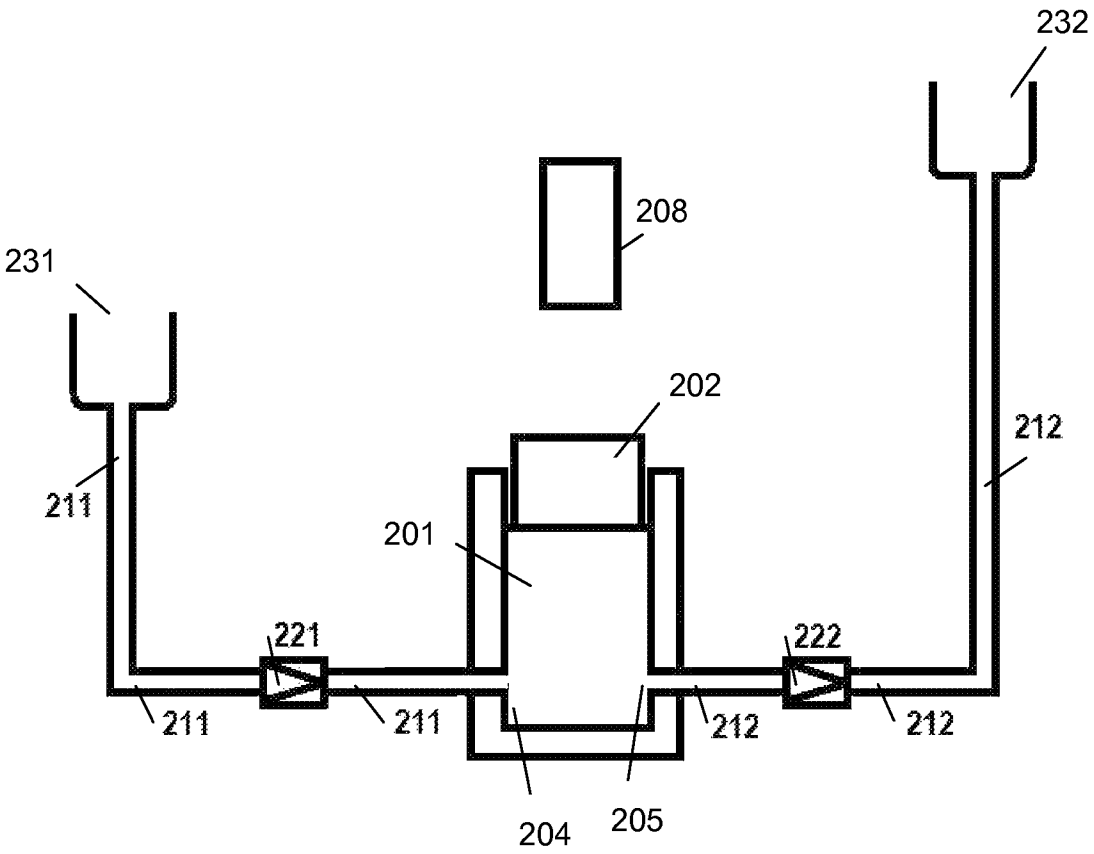
FIG. 2 shows one possible embodiment of the inventive apparatus employing, in addition to reservoirs, conduits and check valves, a hydraulic cylinder, an object and a piston to produce sufficient pressure transients to transfer fluid from one reservoir to another.

The invention will be disclosed with reference to the drawings wherein:

FIG. 2 shows a possible embodiment of the inventive apparatus comprising a system with the following components; a hydraulic cylinder 201 with first and second openings 204,205, a piston 202, first and second pipe lines 211,212 that is connected to first and second openings 204,205 respectively, first and second reservoirs 231,232 connected to first and second pipe lines 211,212, first and second check valves 221,222 in first and second pipe lines 211,212 respectively, and an object 208 which can collide with piston 202. First check valve 221 only allows the fluid to flow in the direction from first reservoir 231 and towards hydraulic cylinder 201, while second check valve 222 only allows fluid to flow in the direction from hydraulic cylinder 201 and towards second reservoir 232.

The total head, i.e. the sum of the hydrostatic head and the friction head, between second reservoir 232 and hydraulic cylinder 201 is larger than the total head, i.e. the hydrostatic head plus the friction head, between first reservoir 231 and hydraulic cylinder 201. Notice that the hydrostatic head between first reservoir 231 and hydraulic cylinder 201 might be larger than the hydrostatic head between second reservoir 232 and hydraulic cylinder 201 even if the difference in the total head is reversed. This would be the case when the friction head is largest between second reservoir 232 and hydraulic cylinder 201.

Object 208 collides with the end of a piston 202, and the sudden movement of piston 202 caused by the collision generates positive pressure transients in hydraulic cylinder 201 which again generate a fluid flow in the direction from the hydraulic cylinder 201 through second check valve 222 and towards second reservoir 232. First and second check valves 221,222 ensure that the positive pressures transient only produce a flow in the above described direction due to their one-way directional properties.

A fraction of the positive pressure transients is likely not to be converted into a fluid flow. Instead this fraction will interact with the solid surfaces within the apparatus, thereby transforming the fraction of positive pressure transients into negative pressure transients within hydraulic cylinder 201. The negative pressure transients generate a fluid flow in the direction from first reservoir 231 through first check valve 221 and towards hydraulic cylinder 201. First and second check valves 221,222 ensure that the negative pressure transients only produce a flow in the above described direction due to the one-way directional properties of valves 221,222. Notice that the hydrostatic head between first reservoir 231 and hydraulic cylinder 201 also contributes to the generation of the described fluid flow.

Figure 3:
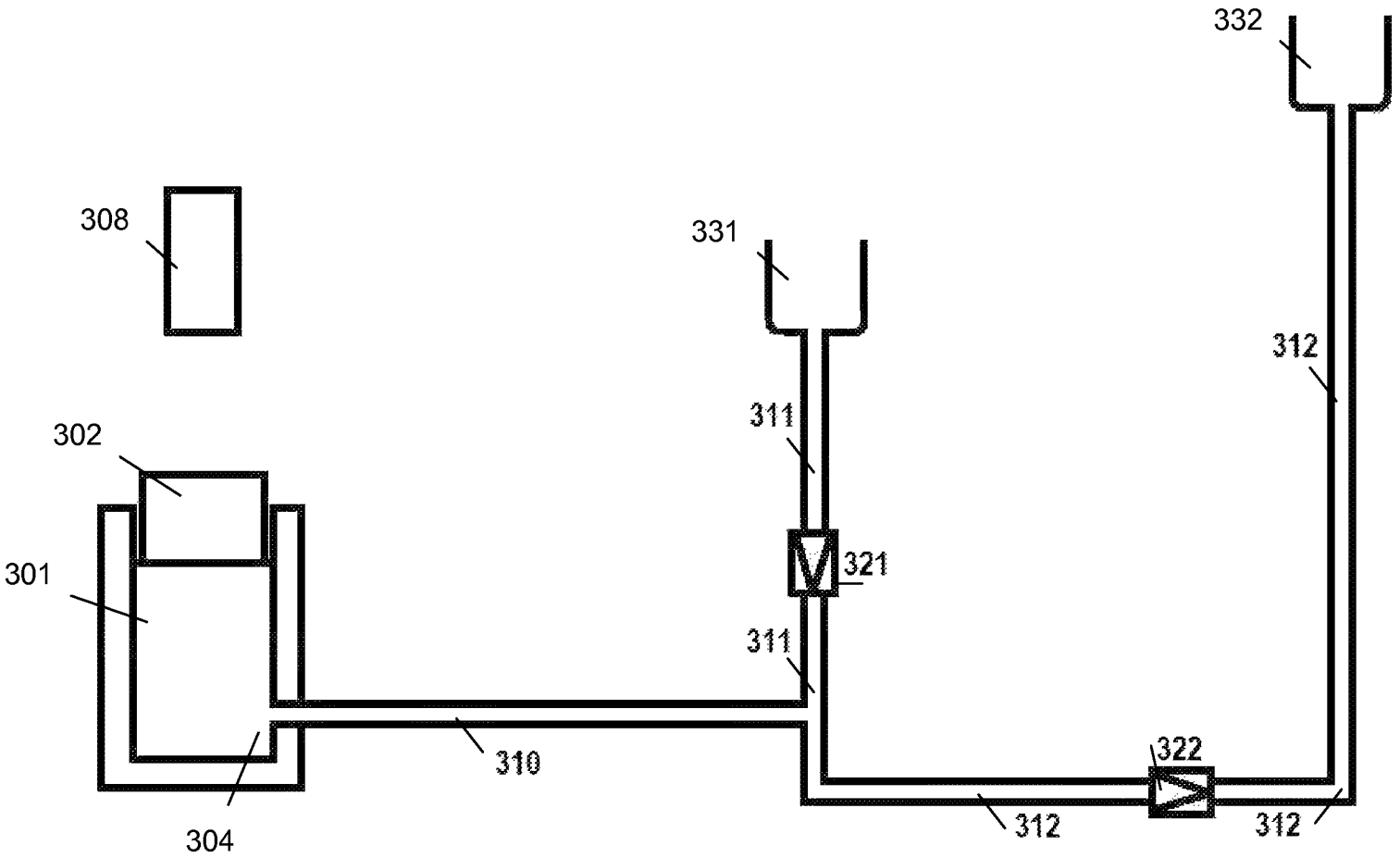
FIG. 3 outlines another embodiment of the inventive apparatus where the hydraulic cylinder has only one common opening.

FIG. 3 outlines a possible embodiment of the inventive apparatus comprising a system with the following components; a hydraulic cylinder 301 with one opening 304, a piston 302, first and second pipe lines 311,312 that are both connected to a third conduit 310, which again is connected to opening 304, first and second reservoirs 331,332 connected to first and second pipe lines 311,312 respectively, first and second check valves 321,322 arranged in first and second conduits 311,312, respectively, and an object 308 which can collide with piston 302. First check valve 321 only allows the fluid to flow in the direction from first reservoir 331 and towards hydraulic cylinder 301, while second check valve 322 only allows fluid to flow in the direction from hydraulic cylinder 301 and towards second reservoir 332.

In this embodiment the hydraulic cylinder has only one opening 304 which is connected to a third conduit 310. First and second conduits 311, 312 are connected at one of their ends to the third conduit 310 and at their opposite ends to first and second reservoirs 331,332, respectively. In the embodiment show in FIG. 3 and described herein only one opening 304 may be applied in hydraulic cylinder 301 since the positive and negative pressure transients do not appear at the same time in hydraulic cylinder 301, hence allowing the fluid to alternately flow into and out of hydraulic cylinder 301 through same opening 304. In addition, the pressure transients do not have the possibility to generate flow through two different openings as in FIG. 2 thus increasing the efficiency compared to the previously mentioned embodiment.

Figure 4:
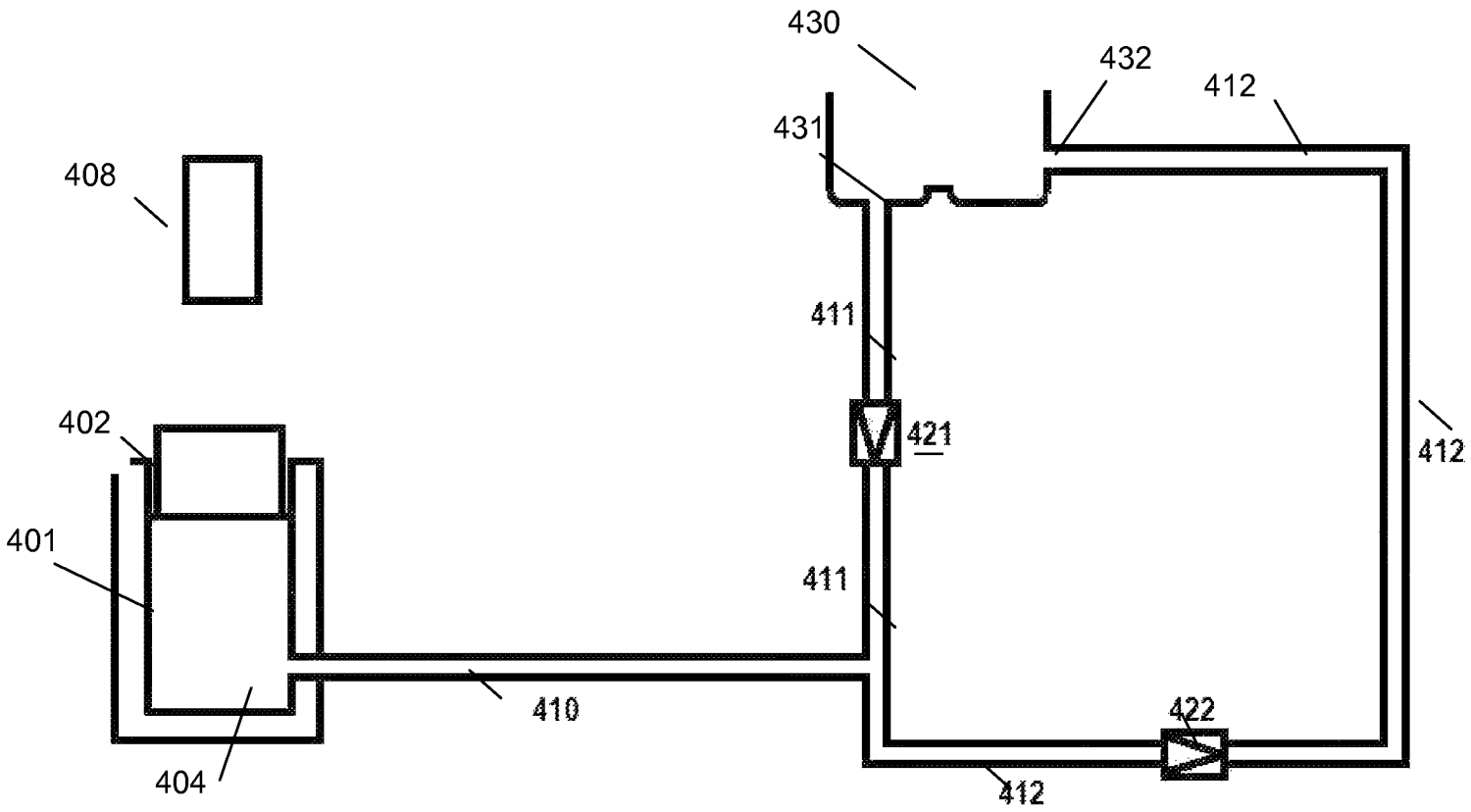
FIG. 4 illustrates another embodiment of the inventive apparatus where there is only one reservoir and both first and second conduits are connected to said reservoir.

FIG. 4 illustrates an alternative embodiment of the inventive apparatus comprising a system with the following components; a hydraulic cylinder 401 with one opening 404, a piston 402, first and second pipe lines 411,412 that are both connected to a third conduit 410, which again is connected to opening 404, first and second reservoirs 431,432 connected to first and second pipe lines 411,412 respectively, first and second check valves 421,422 arranged in first and second conduits 411,412, respectively, and an object 408 which can collide with piston 402. First check valve 421 only allows the fluid to flow in the direction from first reservoir 431 and towards hydraulic cylinder 401, while second check valve 422 only allows fluid to flow in the direction from hydraulic cylinder 401 and towards second reservoir 432. Moreover, in this embodiment first reservoir 431 and second reservoir 432 are merged to constitute one common reservoir 430.

This embodiment has only one common reservoir 430 in which both first and second conduits 411,412 are connected. Such embodiment is advantageous when applied as heat exchange systems such as heating or cooling systems. One example of the latter application is storage of hot or cold fluid in reservoir 430, using first and second conduits 411,412 as climate distributors to the surrounding environment.

Figure 5:
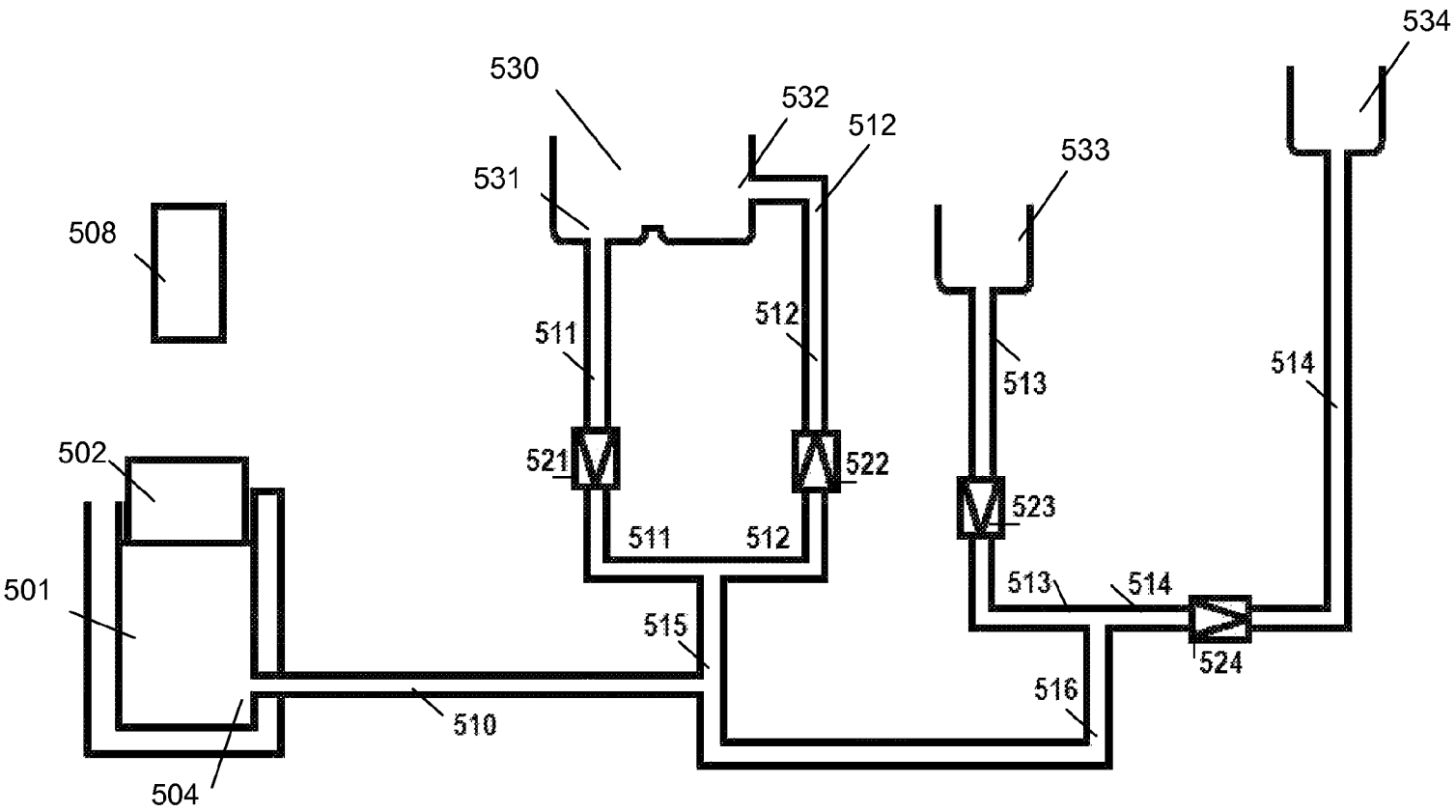
FIG. 5 shows another embodiment of the inventive apparatus where the two fluid transport applications are performed with only one hydraulic cylinder.

FIG. 5 shows a possible embodiment of the inventive apparatus comprising a system with the following components; a hydraulic cylinder 501 with one opening 504, a piston 502, one first and second pipe lines 511,512 that are connected to one third conduit 515, which again is connected to a fourth conduit 510, which again is connected to opening 504, one first and second reservoirs 531,532 connected to first and second pipe lines 511,512 respectively, one first and second check valves 521,522 in first and second pipe lines 511,512 respectively, one additional first and second pipe lines 513,514 that are connected to one additional third conduit 516, which again is connected to fourth conduit 510, one additional first and second reservoirs 533,534 connected to additional first and second pipe lines 513,514 respectively, one additional first and second check valves 523,524 in additional first and second pipe lines 513,514 respectively, and an object 508 which can collide with piston 502. Moreover, in this embodiment first reservoir 531 and second reservoir 532 are merged to constitute one common reservoir 530.

One of said first check valves 521 only allows the fluid to flow in the direction from first reservoir 531 and towards the hydraulic cylinder 501, while one of said second check valves 522 only allows fluid to flow in the direction from hydraulic cylinder 501 and towards second reservoir 532. Another of said additional first check valves 523 only allows the fluid to flow in the direction from said additional first reservoir 533 and towards hydraulic cylinder 501, while said additional second check valves 524 only allows fluid to flow in the direction from hydraulic cylinder 501 and towards said additional second reservoir 534.

The embodiment shown in FIG. 5 is capable of fulfilling all the functionalities of the embodiments illustrated in FIGS. 3 and 4 applying only one hydraulic cylinder 501. Moreover, if check valves 521,522,523,524 are replaced with other type of valves such as restrictor check valves or throttle check valves the flow energy from hydraulic cylinder 501 to each of the fluid transport applications may be more precisely regulated.

Figure 6:
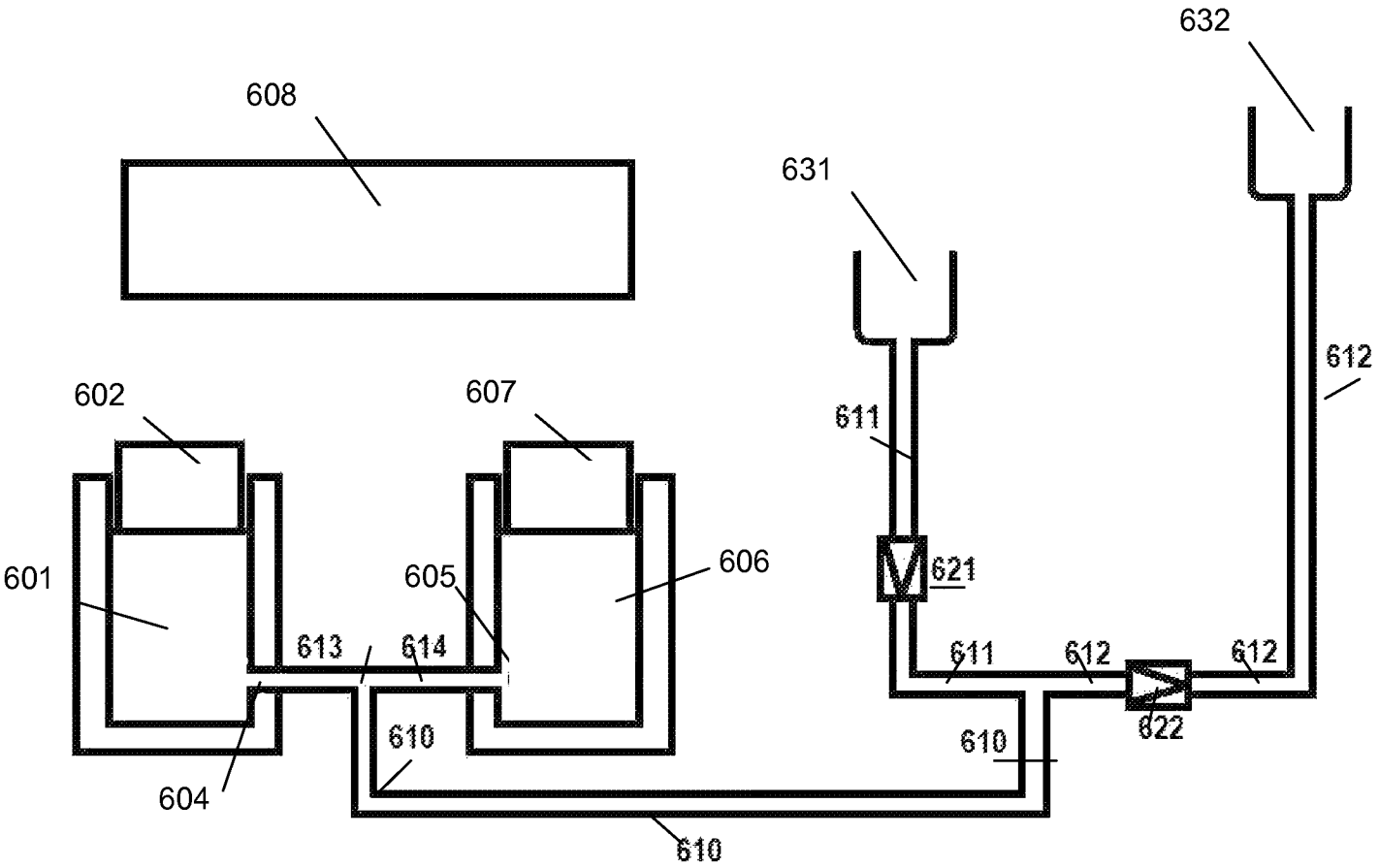
FIG. 6 outlines another embodiment of the inventive apparatus where two hydraulic cylinders are employed to perform a fluid transport application.

FIG. 6 outlines a possible embodiment of the inventive apparatus comprising a system with the following components; a first hydraulic cylinders 601 with one first opening 604, a second hydraulic cylinder 606 with one second opening 605, a first and second pistons 602,607, first and second pipe lines 611,612 both connected to a third conduit 610, which again is connected to a fourth conduit 613 and a fifth conduit 614, first and second reservoirs 631,632 connected to first and second pipe lines 611,612 respectively, first and second check valves 621,622 in first and second pipe lines 611,612 respectively, an object 608 which can collide with pistons 602,607, where fourth conduit 613 and fifth conduit 614 are connected to first and second openings 604,605 respectively. First check valve 611 only allows the fluid to flow in the direction from first reservoir 631 and towards first and second hydraulic cylinders 601, 606, while second check valve 632 only allows fluid to flow in the direction from first and second hydraulic cylinders 601,606 and towards second reservoir 632.

This embodiment applies two hydraulic cylinders 601,606 to perform one fluid transport application. The inventive apparatus is hence not limited to only one hydraulic cylinder for each fluid transport application. Furthermore, one hydraulic cylinder is not limited to perform only one fluid transport application, as described above.

Figure 7:
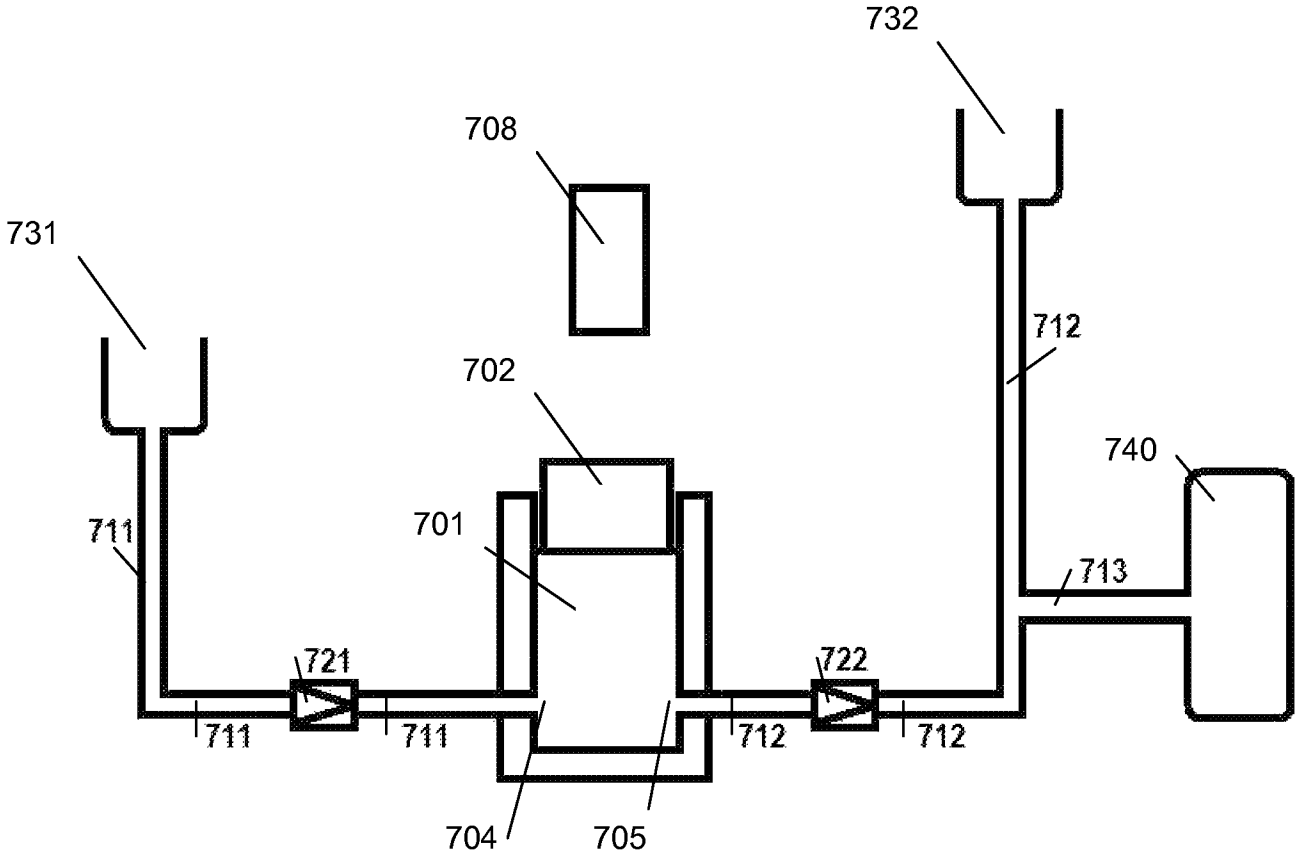
FIG. 7 illustrates another embodiment of the inventive apparatus with an additional chamber mounted on the second conduit leading to the second reservoir.

FIG. 7 illustrates another embodiment of the inventive apparatus comprising a system with the following components; a hydraulic cylinder 701 with first and second openings 704,705, a piston 702, first and second pipe lines 711,712 that is connected to first and second openings 704,705 respectively, first and second reservoirs 731,732 connected to first and second pipe lines 711,711, first and second check valves 721,722 in first and second pipe lines 711,712 respectively, a chamber 740 connected to second conduit 712 between the second check valve 722 and the second reservoir 732 through a third conduit 713, and an object 708 which can collide with piston 702. First check valve 721 only allows the fluid to flow in the direction from first reservoir 731 and towards hydraulic cylinder 701, while second check valve 722 only allows fluid to flow in the direction from hydraulic cylinder 701 and towards second reservoir 732 and/or chamber 740.

Chamber 740 may be a pressure tank or a hydraulic accumulator, and thus a fraction of or all fluids flowing through second check valve 722 can flow into chamber 740. Chamber 740 is preferably filled with both liquid and gas and only the liquid filled part is connected to third conduit 713. The liquid and gas may be separated by a boundary such as a membrane as in the case of a hydraulic accumulator. Such embodiment decreases the resistance of the fluid flow in second conduit 712 since the gas in chamber 740 compresses during the inflow of the fluid from third conduit 713 and thus fluid can flow more easily into chamber 740 than into second reservoir 732. The gas starts to decompress when the fluid flow through second check valve 722 stops and the flow into chamber 740 halts. As a result of the gas decompression fluid begins to flow out of chamber 740 through third conduit 713, where one-way directional second check valve 722 ensures that the fluid flows from chamber 740 into second reservoir 732.

The effect of such arrangement causes more fluid to be transferred to second reservoir 732 per collision. This again serves two purposes:

1. The efficiency of the inventive apparatus increases
2. The flow of fluid into second reservoir 732 becomes more continuous.

The method of connecting a chamber 740 as illustrated in FIG. 7 and described above can also be employed in all the embodiments outlined in FIG. 2-6 and described above.

Figure 8:
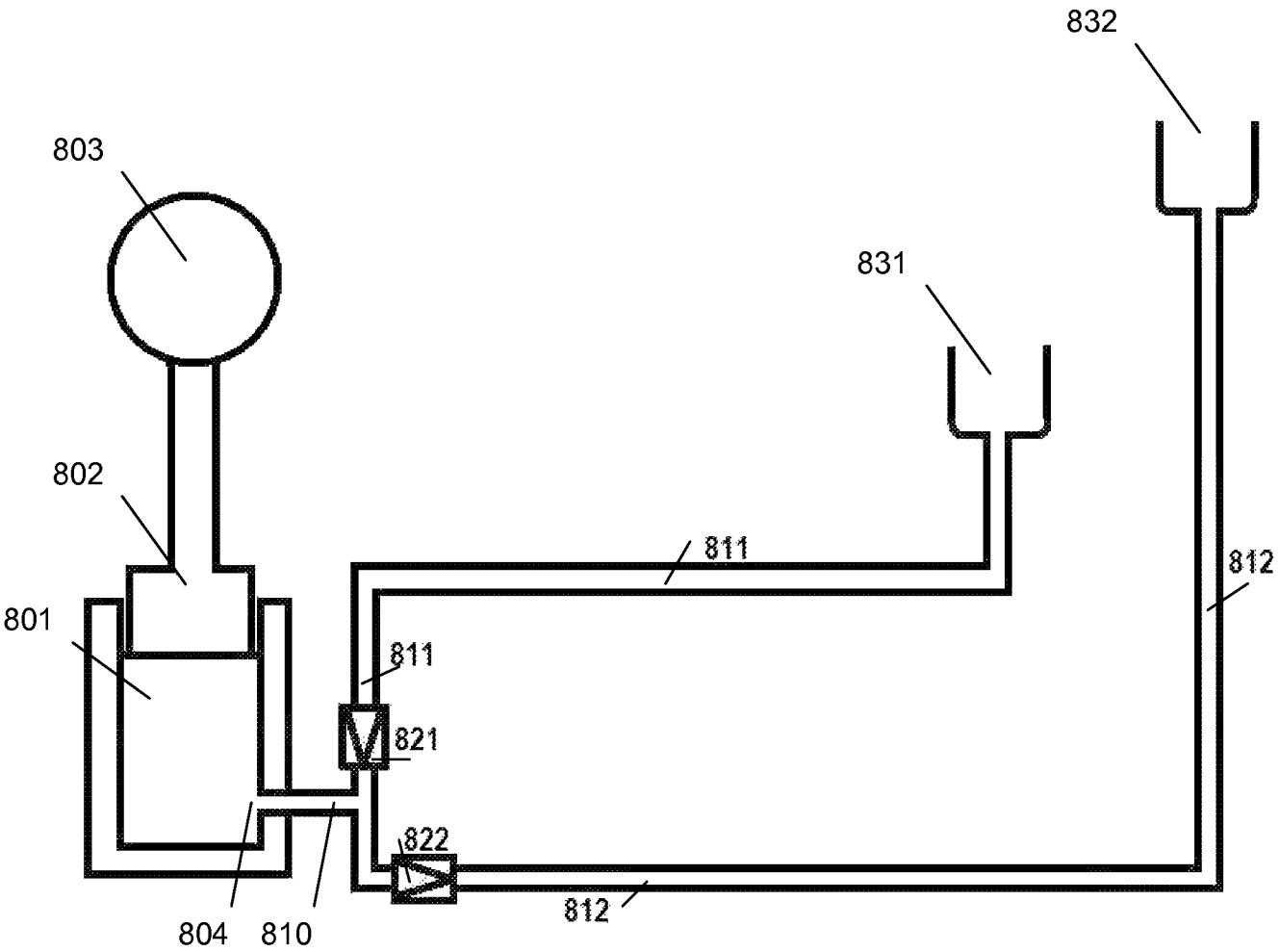
Fig. 8 (Prior Art)
FIG. 8 shows an embodiment of a Prior Art piston pump.

FIG. 8 outlines a possible embodiment of a prior art piston pump comprising a system with the following components; a hydraulic cylinder 801 with one opening 804, a piston 802, first and second conduits 811,812 both connected to a third conduit 810, which again is connected to opening 804, first and second reservoirs 831,832 connected to first and second conduits 811,812 respectively and first and second check valves 821,822 in first and second conduits 811,812 respectively. Piston 802 is directly connected to a machinery device 803 that is capable of moving piston 802.

The prior art piston pump shown in FIG. 8 has some resemblance with the possible embodiment of the inventive apparatus illustrated in FIG. 3. There are however some important differences. One obvious distinction is that piston 802 is directly connected to machinery device 803, in contrast to piston 302 in FIG. 3. Moreover, piston 802 is set in motion by machinery device 803, whereas piston 302 shown in FIG. 3 experiences a sudden movement when object 308 collides with the end of piston 302. In addition, check valves 821,822 must be close to hydraulic cylinder 801 whereas check valves 321,322 may be arranged far from hydraulic cylinder 301. Check valves 821,822 are thus often integrated in the piston pump and hence it becomes a fluid transport device with two openings, which is in contrast to the inventive apparatus shown in FIG. 3 where check valves 321,322 may be placed far from hydraulic cylinder 301 and hence constitute an apparatus for fluid transport with only one opening 304.

Figure 9:
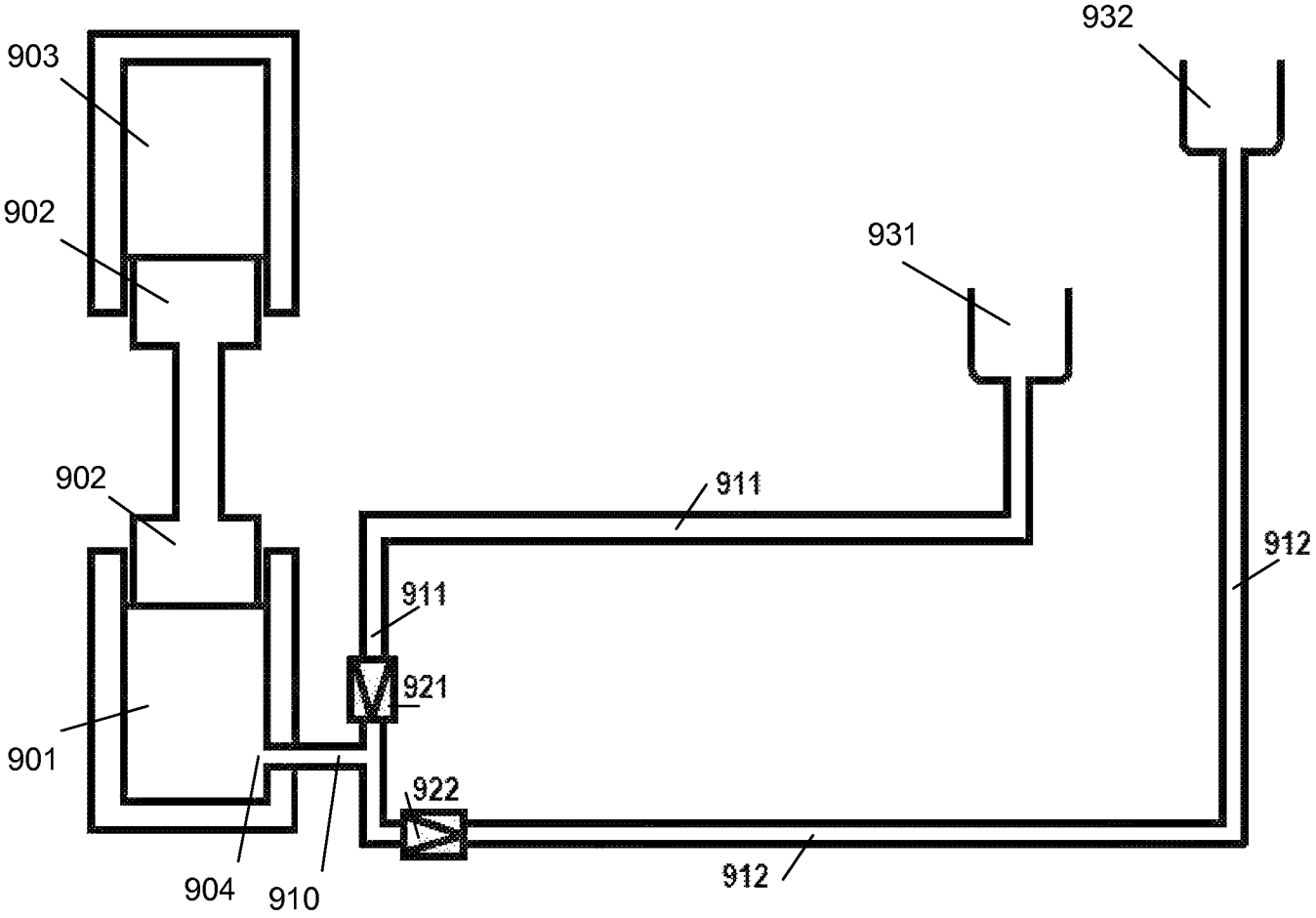
Fig. 9 (Prior Art)
FIG. 9 outlines an embodiment of a Prior Art piston pump.

FIG. 9 illustrates a possible embodiment of a prior art piston pump comprising a system with the following components; a hydraulic cylinder 901 with one opening 904, a piston 902, first and second conduits 911,912 both connected to a third conduit 910, which again is connected to opening 904, first and second reservoirs 931,932 connected to first and second conduits 911,912 respectively and first and second check valves 921,922 in first and second conduits 911,912 respectively. Piston 902 is directly connected to a chamber 903 where an expanding fluid is capable of moving piston 902.

Piston 902 has one end that is inside hydraulic cylinder 901 and the other end is inside chamber 903. Piston 902 is moved by a fluid which can expand inside chamber 903 and thus move piston 902. The movement of piston 902 by the expanding fluid inside the chamber 903 shown in FIG. 9 and the mechanical movement of piston 802 by the machinery 803 outlined in FIG. 8 have one thing in common. The movements by piston 802 and 902 are not sufficiently sudden in order to generate pressure transients inside hydraulic cylinders 802 and 902 respectively. The reason for this is that the movements are not obtained by a collision process as described in the introductory part.

Figure 10:
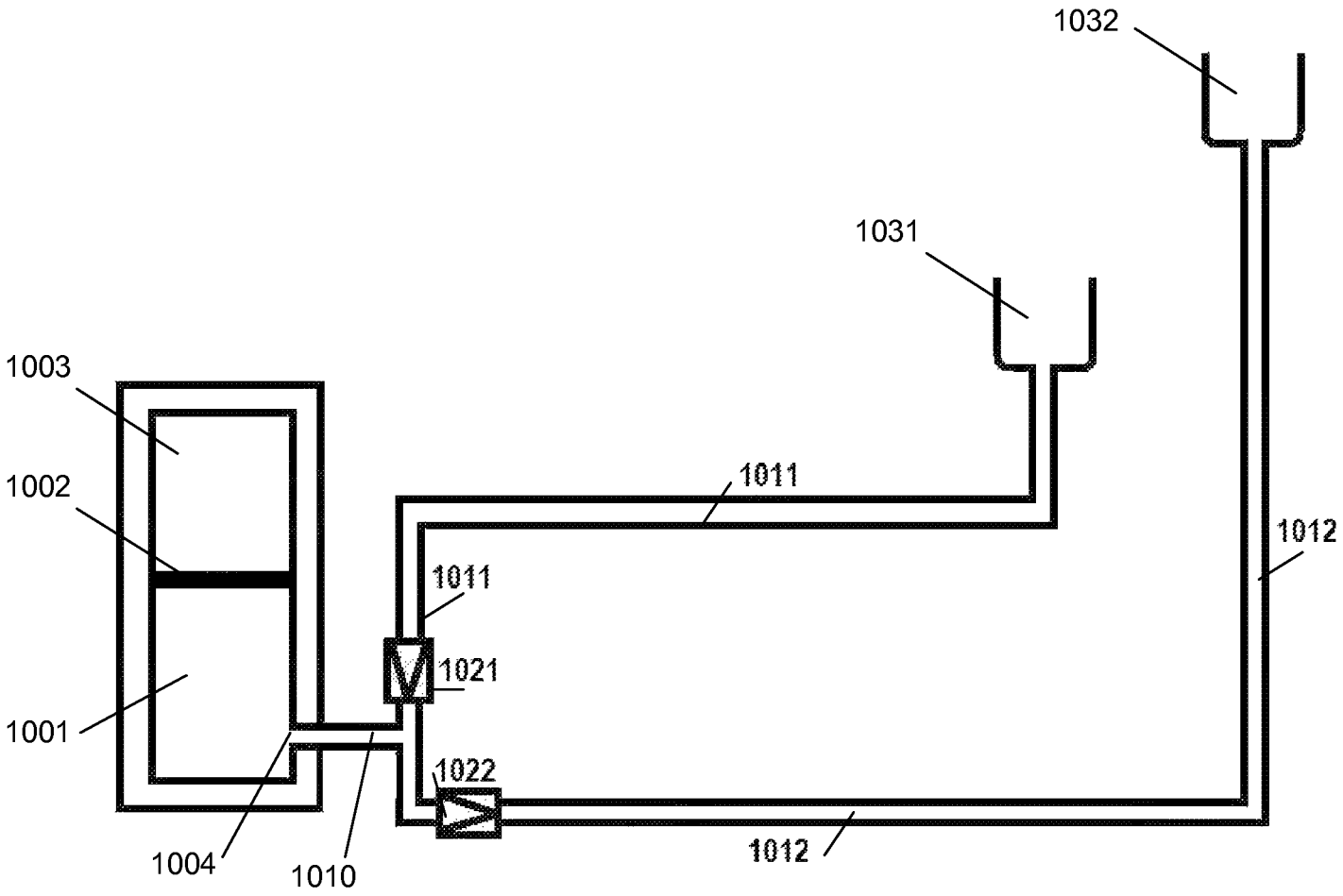
Fig. 10 (Prior Art)
FIG. 10 illustrates an embodiment of a Prior Art displacement pump.

FIG. 10 shows a possible embodiment of a prior art displacement pump comprising a system with the following components; a hydraulic cylinder 1001 with one opening 1004, a membrane 1002, first and second conduits 1011, 1012 both connected to a third conduit 1010, which again is connected to opening 1004, first and second reservoirs 1031,1032 connected to first and second conduits 1011,1012 respectively and first and second check valves 1021,1022 in first and second conduits 1011,1012 respectively. Membrane 1002 constitutes a separation of hydraulic cylinder 1001 from a chamber 1003 where an expanding fluid is capable of moving membrane 1002.

Membrane 1002 is moved by a fluid which can expand inside chamber 1003 and thus move membrane 1002. Movement by membrane 1001 is not able to generate pressure transients inside hydraulic cylinder 1002. The reason for this is that the movement is not obtained by a collision process as described in the introductory part.

Figure 11:
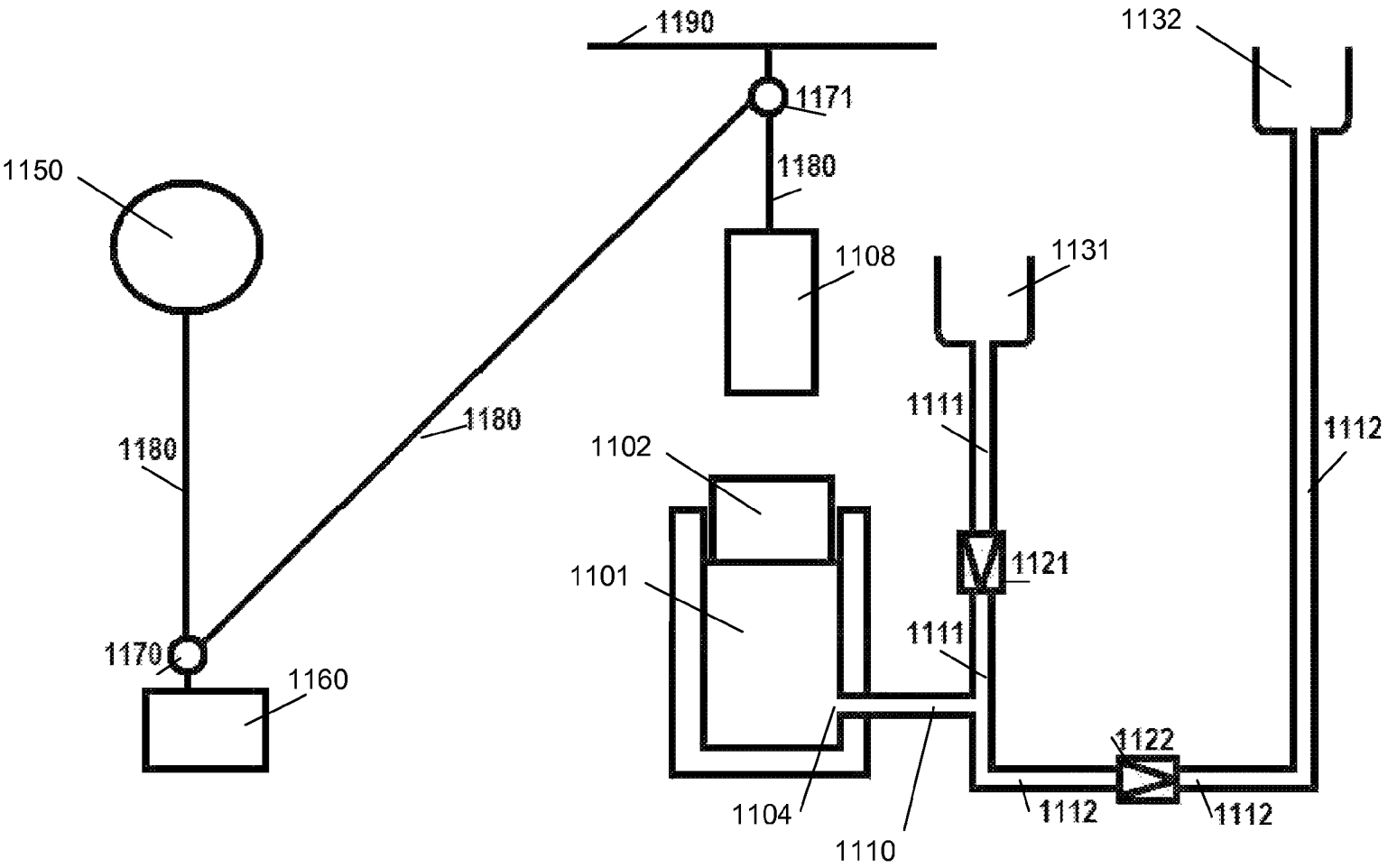
FIG. 11 shows an application of the inventive apparatus in order to capture the energy in ocean wave motions applying a buoy that is floating in the ocean.

FIG. 11 outlines a possible embodiment of the inventive apparatus comprising a system with the following components; a hydraulic cylinder 1101 with one opening 1104, a piston 1102, first and second pipe lines 1111,1112 that are both connected to a third conduit 1110, which again is connected to opening 1104, first and second reservoirs 1131,1132 connected to first and second pipe lines 1111,1112 respectively, first and second check valves 1121,1122 arranged in first and second conduits 1111,1112, respectively, and an object 1108 which can collide with piston 1102. First check valve 1121 only allows the fluid to flow in the direction from first reservoir 1131 and towards hydraulic cylinder 1101, while second check valve 1122 only allows fluid to flow in the direction from hydraulic cylinder 1101 and towards second reservoir 1132. Furthermore, object 1108 is connected to a floating buoy 1150 with a wire 1180 which is running through two pulleys 1170, 1171 where one pulley 1170 is anchored to a sinker 1160 and the other pulley 1171 is linked to a fixed construction 1190.

Floating buoy 1150 is floating in the ocean and can be set in motion by the ocean waves, and thus producing a movement of object 1108. Hence, object 1108 gains a nonzero momentum before it collides with body 1102.

Figure 12:
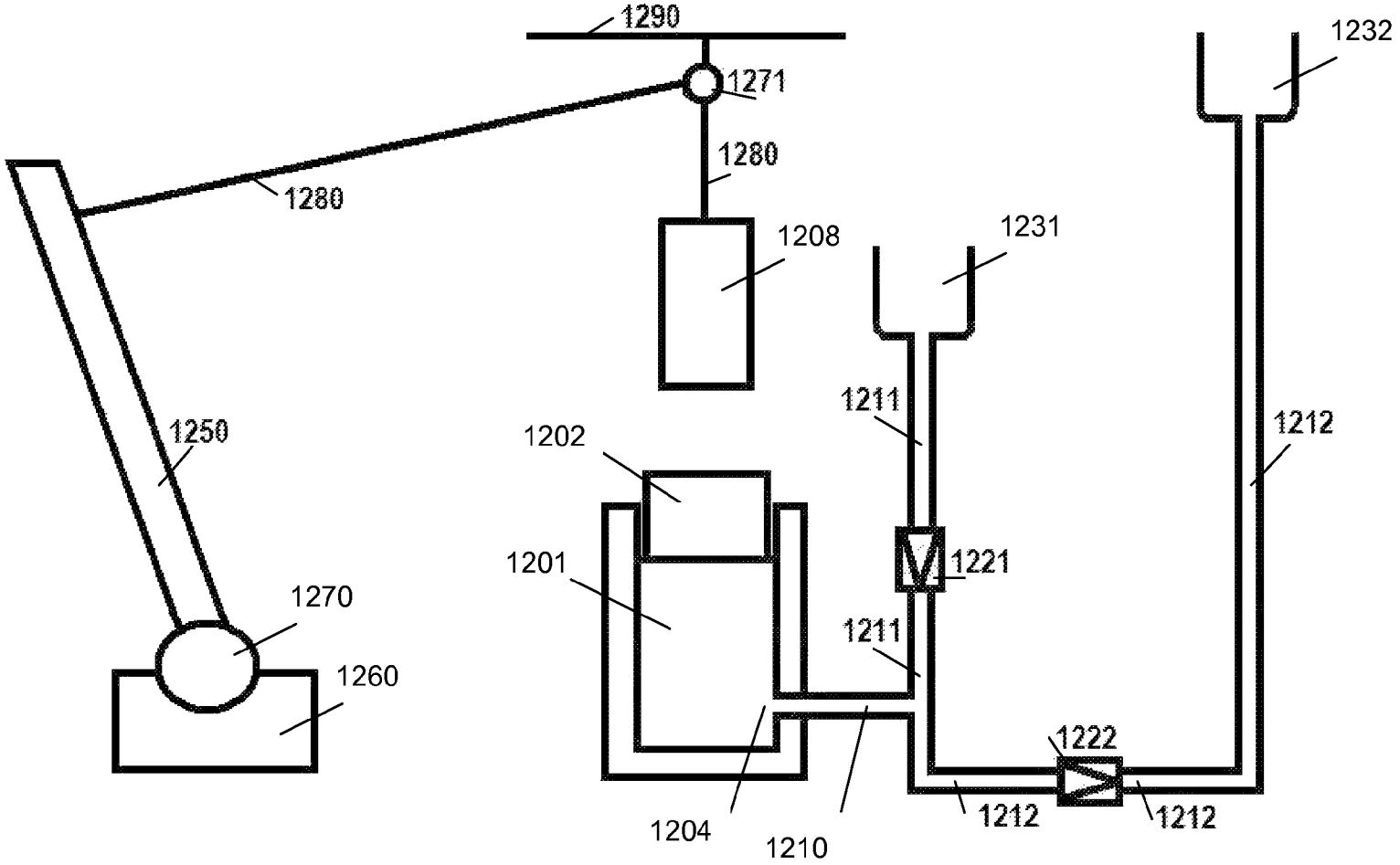
FIG. 12 outlines an application of the inventive apparatus in order to capture the energy in ocean wave motions applying a wall that is partly submerged into the ocean.

FIG. 12 illustrates a possible embodiment of the inventive apparatus comprising a system with the following components; a hydraulic cylinder 1201 with one opening 1204, a piston 1202, first and second pipe lines 1211,1212 that are both connected to a third conduit 1210, which again is connected to opening 1204, first and second reservoirs 1231,1232 connected to first and second pipe lines 1211, 1212 respectively, first and second check valves 1221,1222 arranged in first and second conduits 1211,1212, respectively, and an object 1208 which can collide with piston 1202. First check valve 1221 only allows the fluid to flow in the direction from first reservoir 1231 and towards hydraulic cylinder 1201, while second check valve 1222 only allows fluid to flow in the direction from hydraulic cylinder 1201 and towards second reservoir 1232. Furthermore, object 1208 is connected to a wall 1250 with a wire 1280 which is running through a pulley 1271 which is linked to a fixed construction 1290 and where wall 1250 is anchored to a sinker 1260 with a joint 1270.

Wall 1250 is partly submerged into the ocean and can be set in motion by the ocean waves, and thus producing a movement of object 1208. Hence, object 1208 gains a nonzero momentum before it collides with body 1202.

The invention claimed is:

1. An apparatus for transporting fluids from a first reservoir to a second reservoir, the apparatus comprising:

at least one partly enclosed space;

at least one body placed in said at least one partly enclosed space, where said at least one body is movable relatively to the interior of said at least one partly enclosed space;

at least one opening in said at least one enclosed space which allows a fluid to flow alternately in the direction into and out of said at least one partly enclosed space;

at least one first conduit and at least one second conduit in fluid communication with at least one of said at least one opening and connected to the first and second reservoir, respectively;

at least one liquid and gas filled chamber, wherein at least one solid object is arranged to fall onto and collide with said at least one body so as to generate pressure transients in at least one of said at least one partly enclosed space in order to produce a flow of fluid in the direction from said at least one partly enclosed space towards said second reservoir, and to produce a flow of fluid in the direction from said first reservoir towards said at least one partly enclosed space, and wherein a liquid filled part of the at least one liquid and gas filled chamber is in fluid communication with the at least one partly enclosed space and with said at least one second reservoir.

2. The apparatus for transporting fluids according to claim 1, wherein a flow of fluid into said at least one partly enclosed space is assured by arranging at least one of said at least one first reservoir with a sufficiently hydrostatic head between at least one of said at least one partly enclosed space and at least one of said at least one first reservoir so that said sufficient flow of fluid comes from at least one of said at least one first reservoirs, the flow thereby acting to prevent cavitations occurring in said at least one partly enclosed space.

3. The apparatus for transporting fluids according to claim 1, wherein at least one of said at least one partly enclosed space is a hydraulic cylinder and that at least one of said at least one body is a piston.

4. The apparatus for transporting fluids according to claim 1, wherein the apparatus constitutes at least one heat exchange system.

5. The apparatus for transporting fluids according to claim 1, further comprising at least one first mechanical unit and at least one second mechanical unit in said at least one first conduit and in said at least one second conduit, respectively, where said at least one first mechanical unit only allows flow in said at least one first conduit in the direction from said first reservoir and towards said at least one partly enclosed space, and said at least one second mechanical unit only allows flow in said at least one second conduit in the direction from said at least one partly enclosed space and towards said second reservoir.

6. The apparatus for transporting fluids according to claim 5, wherein the apparatus is placed relative to said first reservoir with a resulting hydrostatic head between said first reservoir and at least one of said at least one partly enclosed space such as to produce a flow of fluid in the direction from said first reservoir through said at least one first mechanical unit and towards said at least one partly enclosed space.

7. The apparatus for transporting fluids according to claim 5, wherein said at least one first mechanical unit and at least one second mechanical units correspond to at least one of the following valves; one-way valves, check valves, restrictor check valves, throttle check valves, restrictor one-way valves, throttle one-way valves, and check valves.

8. The apparatus for transporting fluids according to claim 5, wherein at least one third conduit is connected to the liquid filled parts of the at least one chamber, and said at least one third conduit is in fluid communication with said at least one partly enclosed space through said at least one second mechanical unit, and said at least one third conduit is in fluid communication with said at least one second reservoir.

9. The apparatus for transporting fluids according to claim 8, wherein at least one membrane within at least one of said at least one chamber separates said liquid and said gas.

10. The apparatus for transporting fluids according to claim 8, wherein at least one of said at least one first reservoirs, at least one said second reservoirs, or at least one said chambers is a pressure tank.

11. Apparatus for transporting fluids according to claim 1, wherein the apparatus constitute at least one energy converting system where at least one of said at least one second reservoir is a hydropower reservoir so that the potential energy of the fluid in at least one of said at least one second reservoir can be converted into electric energy by employing at least one hydropower turbine.

12. The apparatus for transporting fluids according to claim 11, wherein said apparatus operates as an energy converting system wherein at least one of said at least one object is connected to at least one wave motion capturing system.

13. The apparatus for transporting fluids according to claim 12, wherein said apparatus operates as an apparatus for capturing the energy in the wave motions, wherein said at least one wave motion capturing system comprises at least one floating buoy which can be set in motion by waves, and where the motion of said at least one floating buoy induces movement of said at least one object, prior to the collision with at least one of said at least one body.

14. The apparatus for transporting fluids according to claim 13, wherein said at least one floating buoy is connected to at least one cord running through at least two pulleys, and where at least one pulley is anchored to at least one sinker and at least one pulley is linked to a fixed construction.

15. The apparatus for transporting fluids according to claim 12, wherein said apparatus operates as an apparatus for capturing the energy in the wave motions, wherein said at least one wave motion capturing system comprises at least one wall which can be set in motion by waves, and where the motion of said at least one wall induces movement of the said at least one object, prior to collision with at least one of said at least one body.

16. The apparatus for transporting fluids according to claim 15, wherein said at least one wall is connected to at least one cord running through at least one pulley that is linked to a fixed construction, and where said at least one wall is anchored to at least one sinker with at least one joint.

17. A method for transporting a fluid from a first reservoir to a second reservoir, comprising:

connecting the reservoirs to a first and a second conduit, respectively, the conduits being in fluid communication with at least one opening in an at least partly enclosed space;

providing at least one liquid and gas filled chamber, wherein a liquid filled part of the at least one liquid and gas filled chamber is in fluid communication with the at least one partly enclosed space and with the second reservoir; and making at least one solid object fall onto and collide with at least one body placed in said at least one partly enclosed space movable relatively to the interior of said at least one partly enclosed space, thereby generating pressure transients in at least one of said at least one partly enclosed space producing a flow of fluid in the direction from said at least one partly enclosed space towards said second reservoir, and producing a flow of fluid in the direction from said first reservoir towards said at least one partly enclosed space.

* * * * *